US007697859B2

(12) United States Patent
Mori et al.

(10) Patent No.: US 7,697,859 B2
(45) Date of Patent: Apr. 13, 2010

(54) IMAGE FORMING APPARATUS FOR CONTROLLING THE CAPABILITY OF COOLING SHEETS

(75) Inventors: Akihito Mori, Toride (JP); Keizo Isemura, Koganei (JP)

(73) Assignee: Canon Kabushiki Kaisha, Tokyo (JP)

( * ) Notice: Subject to any disclaimer, the term of this patent is extended or adjusted under 35 U.S.C. 154(b) by 840 days.

(21) Appl. No.: 11/469,362

(22) Filed: Aug. 31, 2006

(65) Prior Publication Data

US 2007/0053708 A1 Mar. 8, 2007

(30) Foreign Application Priority Data

Sep. 5, 2005 (JP) ..... 2005-257064
Jul. 25, 2006 (JP) ..... 2006-202451

(51) Int. Cl.
*G03G 15/20* (2006.01)

(52) U.S. Cl. ..... 399/69; 399/68; 399/341

(58) Field of Classification Search ..... 399/69, 399/67, 341, 324
See application file for complete search history.

(56) References Cited

U.S. PATENT DOCUMENTS 5,915,146 A 6/1999 Kusaka et al.
2003/0180063 A1 * 9/2003 Kanesawa et al. ..... 399/69
2003/0180074 A1 9/2003 Noya et al.

FOREIGN PATENT DOCUMENTS

| | | | |
|---|---|---|---|
| JP | 64-35452 A | | 2/1989 |
| JP | 4-216580 A | | 8/1992 |
| JP | 4-362679 A | | 12/1992 |
| JP | 5-216322 A | | 8/1993 |
| JP | 2001-166610 A | | 6/2001 |
| JP | 2002307759 A | * | 10/2002 |
| JP | 2003-084477 A | | 3/2003 |
| JP | 2004-151259 A | | 5/2004 |

* cited by examiner

*Primary Examiner*—David M Gray
*Assistant Examiner*—Laura K Roth
(74) *Attorney, Agent, or Firm*—Canon U.S.A., Inc. I.P. Division

(57) ABSTRACT

A first heating device heats a recording sheet having a developer image formed thereon, and a cooling device cools the recording sheet having been heated. A second heating device heats the recording sheet having been cooled, thereby giving gloss to the image on the recording sheet. A cooling capability of the cooling device is switched over in accordance with temperature detected by a temperature sensor which is disposed in a conveying path for the recording sheet under cooling by the cooling device.

4 Claims, 9 Drawing Sheets

IMAGE FORMING APPARATUS FOR CONTROLLING THE CAPABILITY OF COOLING SHEETS

BACKGROUND OF THE INVENTION

1. Field of the Invention

The present invention relates to an image forming apparatus including a plurality of sheet heating devices.

2. Description of the Related Art

Hitherto, image forming apparatuses, such as copying machines and printers, have been widely put into practice by utilizing the electrophotographic process. Some electrophotographic image forming apparatuses are able to form not only a monochromatic image, but also a full-color image. Further, with increasing applications of the electrophotographic image forming apparatuses in various fields, a demand for higher image quality has been established. One of factors deciding the gloss of a full-color image, in particular, is smoothness of the surface of an output image formed on a recording sheet. Therefore, there is a strong demand to increase that smoothness.

In replying to such a demand, an image forming apparatus is proposed in which a color image is formed by transferring and fusing an image of color toner made of a thermoplastic resin onto a recording sheet coated with a transparent resin layer made of a thermoplastic resin (see, e.g., Japanese Patent Laid-Open No. 64-35452 and No. 5-216322).

As a fusing unit suitable for the above-mentioned image forming method, a belt fusing unit employing a belt is proposed (see, e.g., Japanese Patent Laid-Open No. 4-216580 and No. 4-362679). In the proposed belt fusing unit, a recording sheet carrying a not-yet-fused toner image thereon is pressed under heating by the fusing unit belt made of a heat-resistant film, and the recording sheet is cooled while it is kept in close contact with the fusing unit belt. Thus, the toner image is solidified and fixated onto the recording sheet. The recording sheet including the fixated toner image is separated from the fusing unit belt and ejected to the outside.

With that related art, the toner image is solidified together with a transparent resin layer following the surface shape of the belt by the action of the belt fusing unit into such a state that the toner image is buried in the transparent resin layer of the recording sheet. As a result, the entire surface of the recording sheet is finished to a smooth surface and a color image having a superior gloss can be obtained.

In one proposed example of the recording sheet having the transparent resin layer, the transparent resin layer contains, as a main component, a thermoplastic resin having a glass transition temperature of not higher than 358K and is formed in thickness of about 10 μm (see, e.g., Japanese Patent Laid-Open No. 2003-084477).

One known example of an image forming apparatus capable of forming an image on a recording sheet having a transparent resin layer comprises a first fusing unit and a second fusing unit, the latter being constituted by a belt fusing unit. In such an image forming apparatus, a first fusing mode and a second fusing mode are switched over depending on the type of the recording sheet. The first fusing mode is a fusing mode for an ordinary recording sheet. In the first fusing mode, the recording sheet to which a toner image has been transferred is conveyed such that it passes the first fusing unit, but it does not pass the second fusing unit. The second fusing mode is a fusing mode for a recording sheet having a transparent resin layer. In the second fusing mode, a toner image on the recording sheet having the transparent resin layer is first fused onto the recording sheet by the first fusing unit.

Then, the recording sheet including the fused toner image is sent to the second fusing unit. In the second fusing unit, the toner is further fused into such a state that the toner image is buried in the transparent resin layer on the recording sheet.

Generally, a recording sheet having passed a fusing unit is in a state where heat is accumulated inside the sheet. Therefore, if the recording sheet is conveyed in the heat accumulated state through a curved conveying path, the recording sheet is curled. Also, before a toner image having been heated and pressed by the fusing unit is dried, the toner image is scraped by conveying rollers, guide ribs, etc., thus resulting in a phenomenon that scrape or friction marks appear as unevenness in gloss. In order to suppress curl of the recording sheet and the scrape marks of the toner image, a cooler is disposed to quickly cool the recording sheet immediately after it has passed the first fusing unit. In the first fusing mode, the recording sheet is quickly cooled by the cooler immediately after it has passed the first fusing unit.

In the second fusing mode, when the recording sheet (i.e., the recording sheet having the transparent resin layer) having passed the first fusing unit is quickly cooled as in the first fusing mode, the recording sheet having been temporarily cooled is heated again by the second fusing unit. To heat the temporarily cooled recording sheet again to a predetermined temperature, it is required to increase the heat capacity of the second fusing unit, to raise a level of controllable temperature, or to increase the nip pressure for fusing.

In order to increase the heat capacity of the second fusing unit or to raise a level of controllable temperature in the second fusing unit, however, the amount of electric power supplied to the second fusing unit requires to be increased. This results in an increase of power consumption in the second fusing unit. Also, when the nip pressure for fusing is increased, it is required to increase torque of a motor for driving a fusing roller or a pressing roller. This results in disadvantages that the size of a driving mechanism in the second fusing unit is increased and separation of the recording sheet from the second fusing unit is deteriorated.

SUMMARY OF THE INVENTION

The present invention provides an image forming apparatus capable of overcoming the above-described problems with the related art.

The present invention also provides an image forming apparatus capable of stably outputting an image, which has no unevenness in gloss and has high quality, without increasing wasteful power consumption and enlarging the size of a driving mechanism in a second fusing unit.

Further features of the present invention will become apparent from the following description of exemplary embodiments with reference to the attached drawings.

DESCRIPTION OF THE EMBODIMENTS

An embodiment of the present invention will be described below with reference to the drawings.

Figure 1:
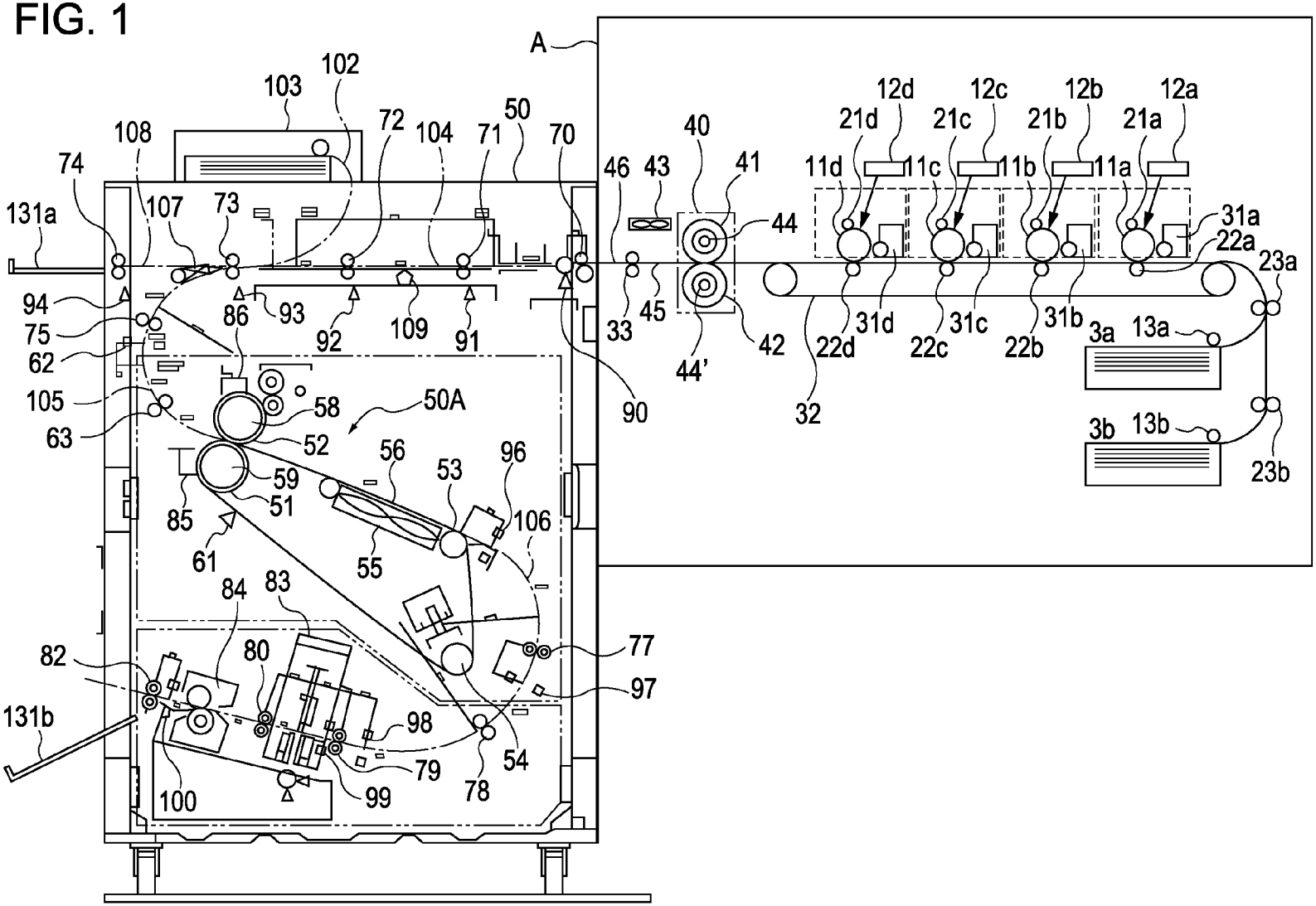
FIG. 1 is a vertical sectional view of an image forming apparatus according to one embodiment of the present invention.

FIG. 1 is a vertical sectional view of an image forming apparatus according to one embodiment of the present invention.

As shown in FIG. 1, an image forming apparatus A is a tandem image forming apparatus capable of forming a color image on a recording sheet (e.g., paper). The image forming apparatus A includes image forming stations in one-to-one relation to yellow, magenta, cyan, and black. The image forming station for yellow includes a photoconductor drum 11*a*, a primary charger 21*a*, a laser unit 12*a*, a developing unit 31*a*, and a transfer unit 22*a*. The primary charger 21*a* uniformly charges the surface of the photoconductor drum 11*a* into a predetermined potential. The laser unit 12*a* irradiates a laser beam onto the photoconductor drum 11*a* while scanning the laser beam. A latent image is thereby formed on the photoconductor drum 11*a*. The developing unit 31*a* supplies toner in a corresponding color to the photoconductor drum 11*a* and visualizes the latent image formed on the photoconductor drum 11*a* into a toner image. The transfer unit 22*a* transfers the toner image on the photoconductor drum 11*a* to the recording sheet which is conveyed from a sheet feed cassette 3*a* or 3*b* by a transfer belt 32.

As in the image forming station for yellow, the image forming station for magenta includes a photoconductor drum 11*b*, a primary charger 21*b*, a laser unit 12*b*, a developing unit 31*b*, and a transfer unit 22*b*. Similarly, the image forming stations for cyan and black include respectively photoconductor drums 11*c*, 11*d*, primary chargers 21*c*, 21*d*, laser units 12*c*, 12*d*, developing units 31*c*, 31*d*, and transfer units 22*c*, 22*d*.

The recording sheet supplied from the sheet feed cassette 3*a* or 3*b* is conveyed to the transfer belt 32 through a sheet feed roller 13*a* or 13*b* and a conveying roller 23*a* or 23*b*. The transfer belt 32 conveys the recording sheet while carrying it such that the recording sheet passes the respective image forming stations in sequence. When the recording sheet passes through the image forming stations, the toner images formed in the image forming stations are successively superimposed one above another on the recording sheet. As a result, a full-color toner image is formed on the recording sheet.

The recording sheet carried by the transfer belt 32 is separated from the transfer belt 32 and is introduced to a first fusing unit (first heating device) 40. The first fusing unit 40 comprises a fusing roller 41 with a heater 44 disposed therein, and a pressing roller 42 with a heater 44' disposed therein. The fusing roller 41 and the pressing roller 42 are pressed against each other with a predetermined pressure. Between the fusing roller 41 and the pressing roller 42, a nip portion is formed to convey the recording sheet while nipping it between those rollers. Respective surface temperatures of the fusing roller 41 and the pressing roller 42 are held at a predetermined fusing temperature by controlling energization of the heaters 44 and 44'. In the first fusing unit 40, heat and pressure are applied to the recording sheet when the recording sheet passes the nip portion. As a result, the toner image on the recording sheet is fused and fixated to the recording sheet.

Note that the construction of the image forming apparatus A is not limited to the above-described one. For example, the known construction employing an intermediate transfer belt instead of the transfer belt may also be used.

The recording sheet having passed the first fusing unit 40 is introduced toward an ejection roller 33 along a conveying path 45, and the ejection roller 33 sends the recording sheet to the second fusing unit 50 along a conveying path 46. At a position near an outlet of the first fusing unit 40, a cooling fan 43 is disposed to cool the recording sheet having passed the first fusing unit 40.

The second fusing unit 50 includes a belt fusing unit (second heating device) 50A. In the second fusing unit 50, the recording sheet introduced from the image forming apparatus A is conveyed toward a flapper 107 along a conveying path 104 by conveying rollers 70, 71, 72 and 73. A temperature sensor 109 is disposed at a position between the conveying rollers 71 and 72. Also, a plurality of sensors 90, 91, 92 and 93 for sensing the recording sheet are disposed along the conveying path 104.

The flapper 107 is operated so as to switch over a conveyed destination of the recording sheet depending on a fusing mode described below. When the selected fusing mode is a first fusing mode, the flapper 107 performs the switching operation such that the recording sheet is introduced to a conveying path 108. The recording sheet introduced to the conveying path 108 by the flapper 107 is ejected onto a sheet ejection tray 131*a* through an ejection roller 74. A sensor 94 for sensing the recording sheet is disposed at a position near the ejection roller 74.

When the selected fusing mode is a second fusing mode, the flapper 107 performs the switching operation such that the recording sheet is introduced to a conveying path 105. The recording sheet introduced to the conveying path 105 is conveyed to a registration roller 63 by a transport roller 75. The registration roller 63 temporarily stops the recording sheet and then sends it toward the belt fusing unit 50A at predetermined timing. Details of the belt fusing unit 50A will be described later. A registration sensor 62 for sensing the leading edge of the recording sheet is disposed at a position between the conveying roller 75 and the registration roller 63 along the conveying path 105.

The recording sheet having passed through the belt fusing unit 50A is sent to a cutter 83 by conveying rollers 77, 78 and 79 along a conveying path 106. The cutter 83 cuts right and left ends (opposite edges extending in the conveying direction) of the recording sheet at a predetermined width. The recording sheet having been cut at the right and left ends by the cutter 83 is sent to another cutter 84 by a conveying roller 80. The cutter 84 cuts leading and trailing ends (opposite edges extending in a direction perpendicular to the conveying direction) of the recording sheet at a predetermined width. The predetermined widths cut by the cutters 83 and 84 are narrower than respective margin widths at the right and left ends and the leading and trailing ends of the recording sheet. Positioning of the recording sheet relative to the cutters 83 and 84 is performed by the conveying rollers 79, 80 and 81. The recording sheet having been cut at the leading and trailing ends by the cutter 84 is ejected onto a sheet ejection tray 131*b* by an ejection roller 82.

A plurality of sensors 96, 97 and 98 for sensing the recording sheet are disposed along the conveying path 106. Also, a sensor 99 for sensing the recording sheet is disposed downstream of the conveying roller 79. Further, a sensor 100 for sensing the recording sheet is disposed at a position between the cutter 84 and the ejection roller 82.

An inserter 103 is provided in the second fusing unit 50. The inserter 103 feeds an insert sheet along a conveying path 102 such that the insert sheet is inserted between the recording sheets.

The belt fusing unit 50A has an endless fusing unit belt 56 for advancing the recording sheet while carrying it thereon. The fusing belt 56 is looped over a fusing roller 51, a driven roller 53, and a tension roller 54. The fusing belt 56 is driven by the fusing roller 51, and the home position of the fusing belt 56 is detected by a sensor 61. A pressing roller 52 is disposed opposite to the fusing roller 51 with the fusing belt 56 interposed between them and is pressed against the fusing roller 51 using a predetermined pressure.

The fusing belt 56 comprises an endless base member and a specular (mirror-like) layer capable of easily releasing from the recording sheet or the pressing roller (i.e., a releasable layer), which is formed on the surface of the base member (i.e., the surface coming into contact with the recording sheet or the pressing roller 52). For example, the base member is formed of a stainless-sheet belt with a thickness of 100 μm. The releasable layer is made of PFA (tetrafluoroethylene perfluoroalkylvinylether copolymer), which is one of fluorocarbon resins, with a thickness of 10 μm.

The fusing roller 51 comprises a core in the form of a cylindrical member, an elastic layer formed on the core surface, and a releasable layer formed on the elastic layer. For example, the core is constituted by an aluminum hollow pipe with a diameter of 44 mm and a thickness of 5 mm. The elastic layer is made of silicone rubber with a JIS-A hardness of 50 degrees and a thickness of 3 mm. The releasable layer is made of PFA with a thickness of 50 μm. Further, a halogen lamp 58 serving as a heat source is disposed inside the core. The pressing roller 52 has a similar structure to that of the fusing roller 51, and a halogen lamp 59 is disposed inside the pressing roller 52.

The surface temperatures of the fusing roller 51 and the pressing roller 52 are detected respectively by thermistors 85 and 86. Energization of the halogen lamps 58 and 59 is controlled in accordance with the temperatures detected by the thermistors 85 and 86 so that the surface temperatures of the fusing roller 51 and the pressing roller 52 are held at a predetermined fusing temperature.

A cooling fan 55 for cooling the recording sheet carried on the fusing belt 56 is disposed between the fusing roller 51 and the driven roller 53. The cooling fan 55 is arranged on the backside of the fusing belt 56 and generates an airflow directing from the backside toward the front side of the fusing belt 56.

The fusing belt 56 is provided with a predetermined tension from the tension roller 54 so that the curvature of the fusing belt 56 in an area where the recording sheet is cooled by the cooling fan 55 is held substantially constant by the rigidity (stiffness) of the fusing belt 56.

In this embodiment, two types of recording sheets, i.e., an ordinary recording sheet (hereinafter referred to as a "first-type recording sheet") and a recording sheet which has a transparent resin layer containing, as a main component, a thermoplastic resin and formed on the sheet surface (hereinafter referred to as a "second-type recording sheet"), can be optionally used as the recording sheet on which image formation is performed. When image formation is performed on the first-type recording sheet, the first fusing mode is selected, and when the image formation is performed on the second-type recording sheet, the second fusing mode is selected.

The first fusing mode is a mode for fusing and fixating a toner image, which is formed on the first-type recording sheet, to the first-type recording sheet by using only the first fusing unit 40 without using the second fusing unit 50. The second fusing mode is a mode for fusing and fixating a toner image, which is formed on the second-type recording sheet, to the second-type recording sheet by using both the first fusing unit 40 and the second fusing unit 50.

Because the belt fusing unit 50A of the second fusing unit 50 serves to give gloss to an image fused by the first fusing unit, the second fusing mode can also be called a gloss applying mode. Similarly, the second fusing unit 50 can also be called a gloss applying device.

The second-type recording sheet comprises a base material having, on at least one surface, a pigment coated layer containing an adhesive and a pigment as main components, and a resin layer formed on the pigment coated layer and containing a thermoplastic resin as a main component. While the resin layer contains a thermoplastic resin and a thermosetting resin as main components, it may be replaced with a mixed resin layer containing the thermoplastic resin and the thermosetting resin in a mixed state. Also, the resin layer may be formed from a plurality of layers including at least one thermoplastic resin layer containing the thermoplastic resin as a main component and at least one thermosetting resin layer containing the thermosetting resin as a main component. When the resin layer is formed from a plurality of layers, an uppermost layer is formed as the thermosetting resin layer containing the thermosetting resin as a main component. Further, the resin layer may be formed in combination of the mixed resin layer, the thermoplastic resin layer, and the thermosetting resin layer. In such a case, an uppermost layer is required to be a layer containing the thermosetting resin, such as the mixed resin layer or thermosetting resin layer. Practically usable examples of the thermoplastic resin are polyester resin, styrene-acrylic ester, and styrene-methacrylic ester. Among them, polyester resin is preferable.

Figure 2:
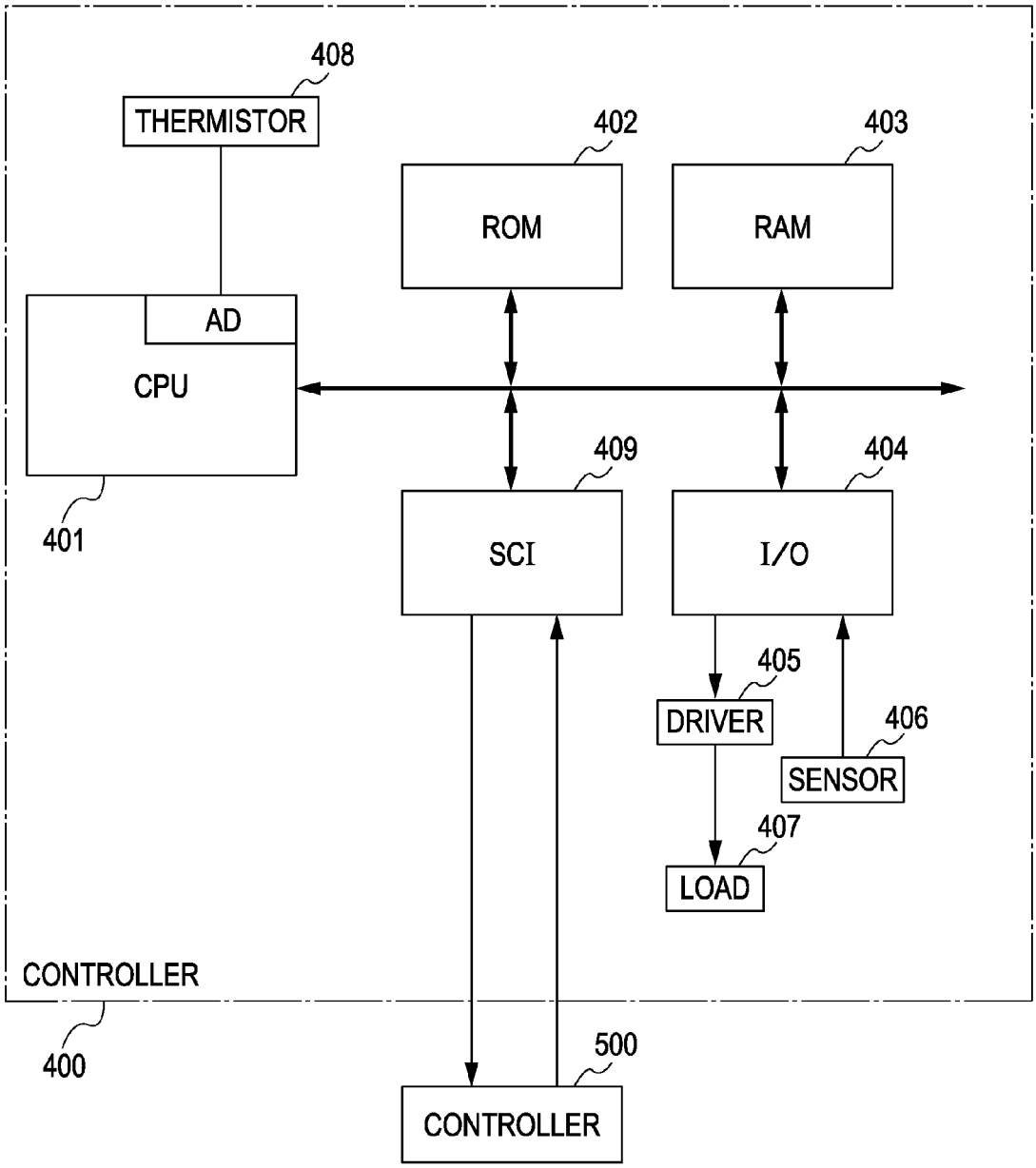
FIG. 2 is a block diagram showing a control configuration to control the entirety of the image forming apparatus.

A control configuration of the entire system, including the image forming apparatus A and the second fusing unit 50, will be described below with reference to FIG. 2. FIG. 2 is a block diagram showing the control configuration to control the entire system including the image forming apparatus A and the second fusing unit 50 shown in FIG. 1.

The control of the entire system including the image forming apparatus A and the second fusing unit 50 is executed by a controller 400, as shown in FIG. 2. The controller 400 comprises a CPU 401, a ROM 402, a RAM 403, an I/O (input/output port) 404, and an SCI (serial communication interface) 409. The ROM 402 stores control programs executed by the CPU 401 and various data. The RAM 403 provides a working area for the CPU 401. The I/O 404 takes in outputs from a group of sensors 406 and sends the taken-in outputs to the CPU 401. The group of sensors 406 includes, for example, a sensor for sensing the recording sheet in the image forming apparatus A and a temperature sensor for detecting the temperature in the image forming apparatus A. Further, the I/O 404 outputs, to drivers 405, control signals which are inputted from the CPU 401 to control driving of a group of various loads 407. The group of various load 407 includes, e.g., driving motors, clutches, and solenoids for operating the cooling fan 43, the fusing roller 41, and the transfer belt 32. Each driver 405 drives the corresponding load in accordance with the control signal. The SCI 409 is connected to the controller 500 of the second fusing unit 50, and the controller 400 transfers information between the controller 400 and the controller 500 via the SCI 409.

The CPU 401 of the controller 400 controls various operations for image formation corresponding to a mode set by a user. For example, the CPU 401 controls energization of the heaters 44 and 44' in accordance with an output of a thermistor 408 for detecting the surface temperature of the fusing roller 41, which is inputted via an AD port. As a result, the surface temperatures of the fusing roller 41 and the pressing roller 42 are controlled to be held at the predetermined fusing temperature. Further, in accordance with the selected fusing mode, the CPU 401 controls driving of the cooling fan 43 so that an output of the cooling fan 43 is changed. Details of the driving control of the cooling fan 43 will be described later.

In accordance with commands inputted from the controller 400 of the image forming apparatus A, the controller 500 of the second fusing unit 50 executes various kinds of control while monitoring outputs of sensors disposed in the second fusing unit 50. For example, the controller 500 executes the temperature control of the belt fusing unit 50A, control for switching over the conveyed destination of the recording sheet by the flapper 107, conveying control of the recording sheet by the conveying rollers, and operation control of the cutters 83 and 84. The controller 500 has the same configuration as that of the controller 400, and a detailed description thereof is omitted here.

The first fusing mode will be described in detail below.

When the image formation is performed on the first-type recording sheet, the first fusing mode is executed. After the toner image has been transferred to the first-type recording sheet, the first-type recording sheet is sent to the first fusing unit 40. The first-type recording sheet including the transferred toner image is heated and pressed in the first fusing unit 40 so that the toner image is fused and fixated to the first-type recording sheet. The first-type recording sheet having passed the first fusing unit 40 is quickly cooled by the cooling fan 43 and is then sent from the image forming apparatus A to the second fusing unit 50.

The first-type recording sheet having been sent to the second fusing unit 50 is conveyed along the conveying path 104 by the conveying rollers 70, 71, 72 and 73 and is then introduced to the conveying path 108 by the flapper 107. The first-type recording sheet introduced to the conveying path 108 is ejected onto the sheet ejection tray 131*a* by the ejection roller 74.

If the first-type recording sheet having passed the first fusing unit 40 is conveyed without being cooled by the cooling fan 43, heat accumulated in the first-type recording sheet is gradually dissipated and the first-type recording sheet is curled correspondingly. Thereafter, the first-type recording sheet is ejected onto a sheet ejection tray 131*a* in the curled state. Continuous ejection of the curled first-type recording sheets onto the sheet ejection tray 131*a* results in a disadvantage that the first-type recording sheets are not neatly stacked on the sheet ejection tray 131*a* and the quality of the output sheets is deteriorated.

Also, if the first-type recording sheet having passed the first fusing unit 40 is conveyed without being cooled by the cooling fan 43, the following disadvantage also occurs. When the toner image having been fused onto the first-type recording sheet is brought into contact with and is scraped by the conveying rollers, guide ribs, etc. before the fused toner image is dried, scraped areas of the toner image appear as unevenness of gloss. As a result, the quality of an image formed on the first-type recording sheet is deteriorated.

Accordingly, the first-type recording sheet having passed the first fusing unit 40 requires to be cooled by the cooling fan 43. The driving of the cooling fan 43 is controlled by the controller 400. Also, when the second fusing unit 50 is not connected to the image forming apparatus A, the first-type recording sheet having passed the first fusing unit 40 is likewise cooled by the cooling fan 43.

Figure 3A:
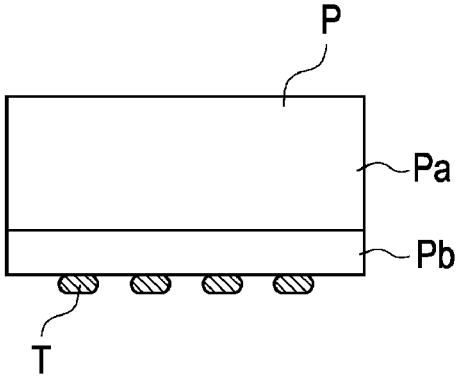
FIG. 3A schematically shows a fused state of a toner image on a second-type recording sheet having passed a first fusing unit, and FIG. 3B schematically shows a fused state of the toner image on the second-type recording sheet having passed a belt fusing unit.
Figure 3B:
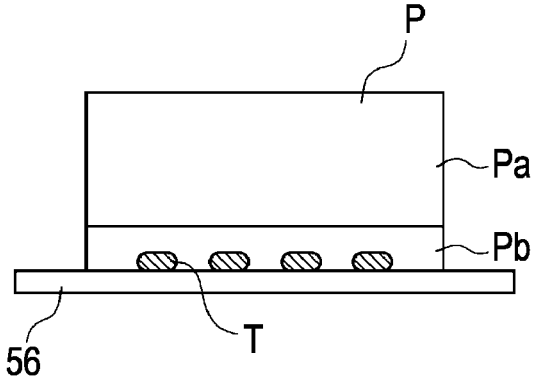
Figure 4:
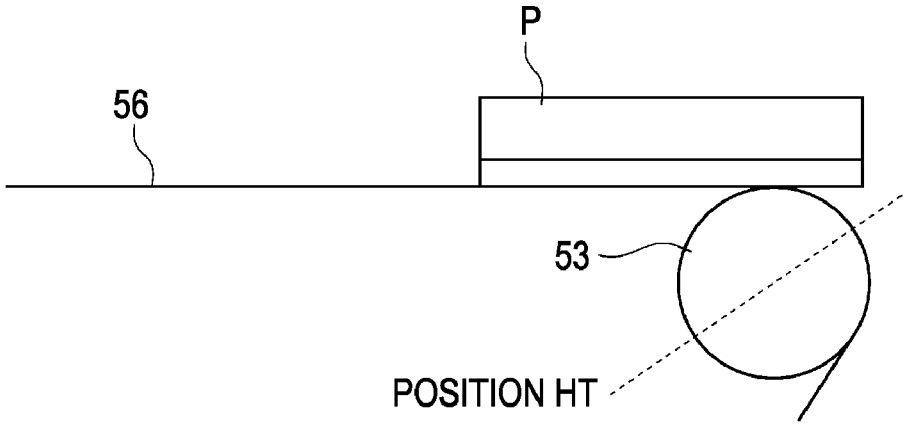
FIG. 4 is a schematic view showing a state when the second-type recording sheet is separated from a fusing belt of a second fusing unit.
Figure 5:
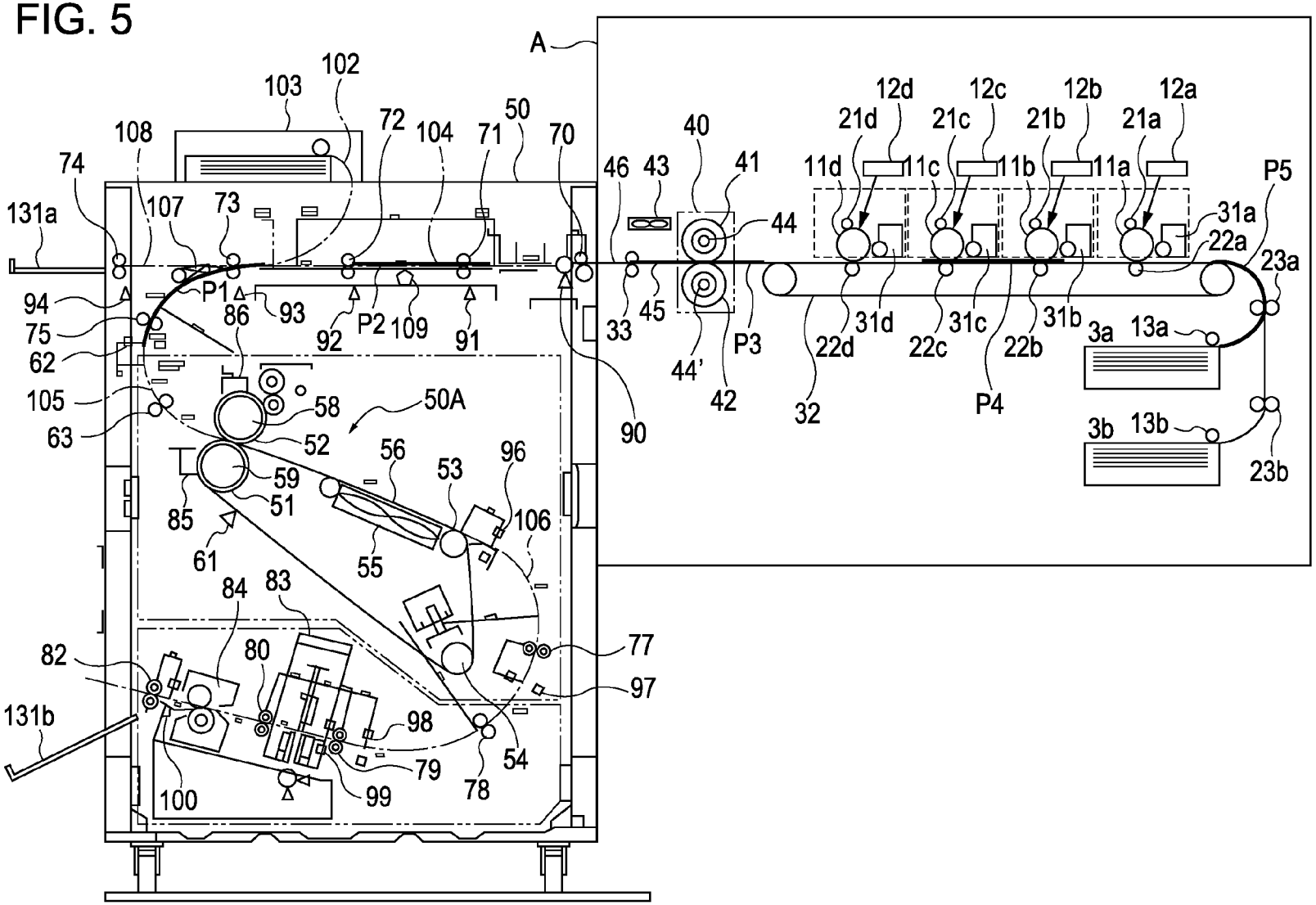
FIG. 5 schematically shows the flow of the second-type recording sheet when image information is continuously performed using the second-type recording sheets.
Figure 6:
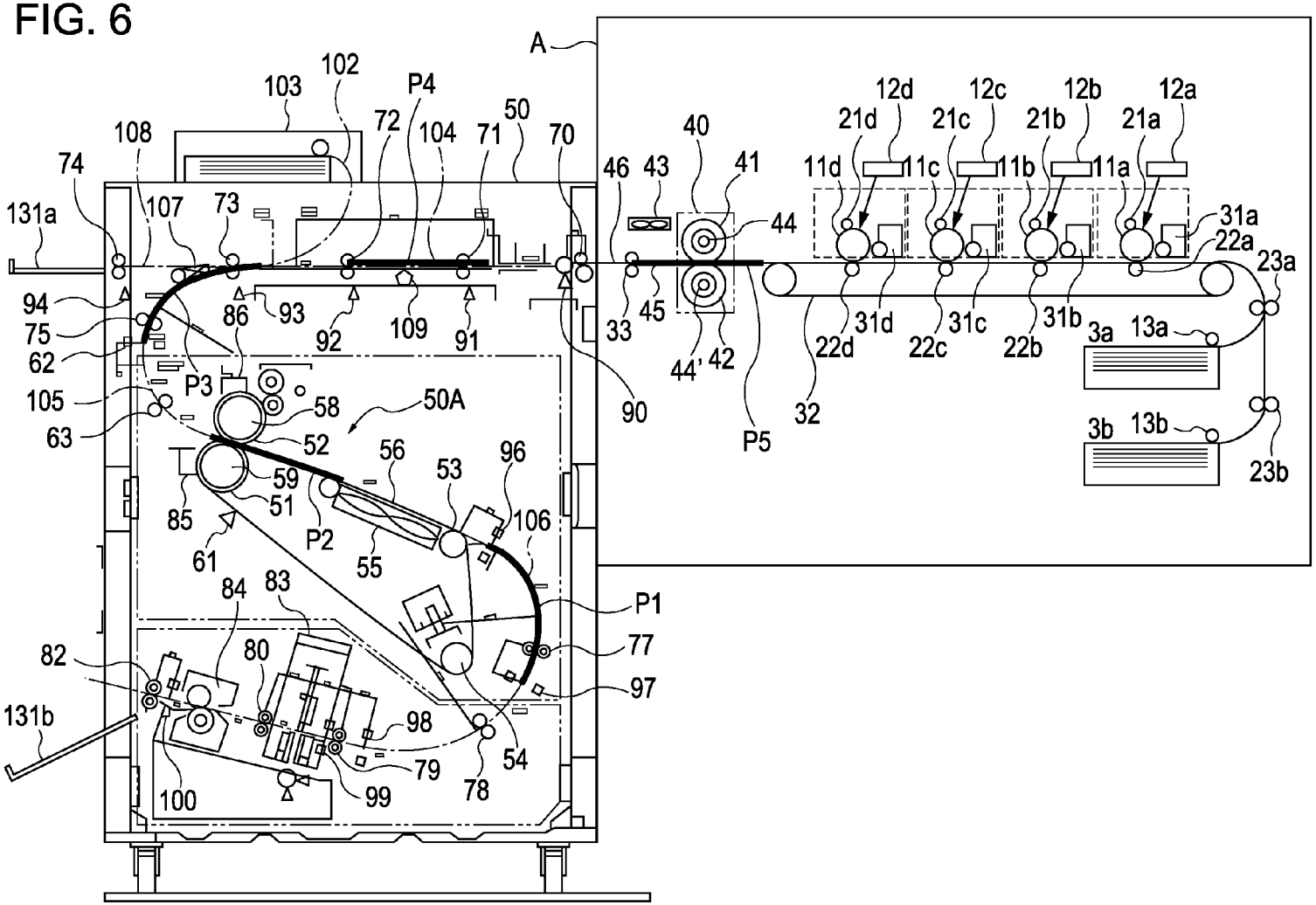
FIG. 6 schematically shows the flow of the second-type recording sheet when image information is continuously performed using the second-type recording sheets.
Figure 7:
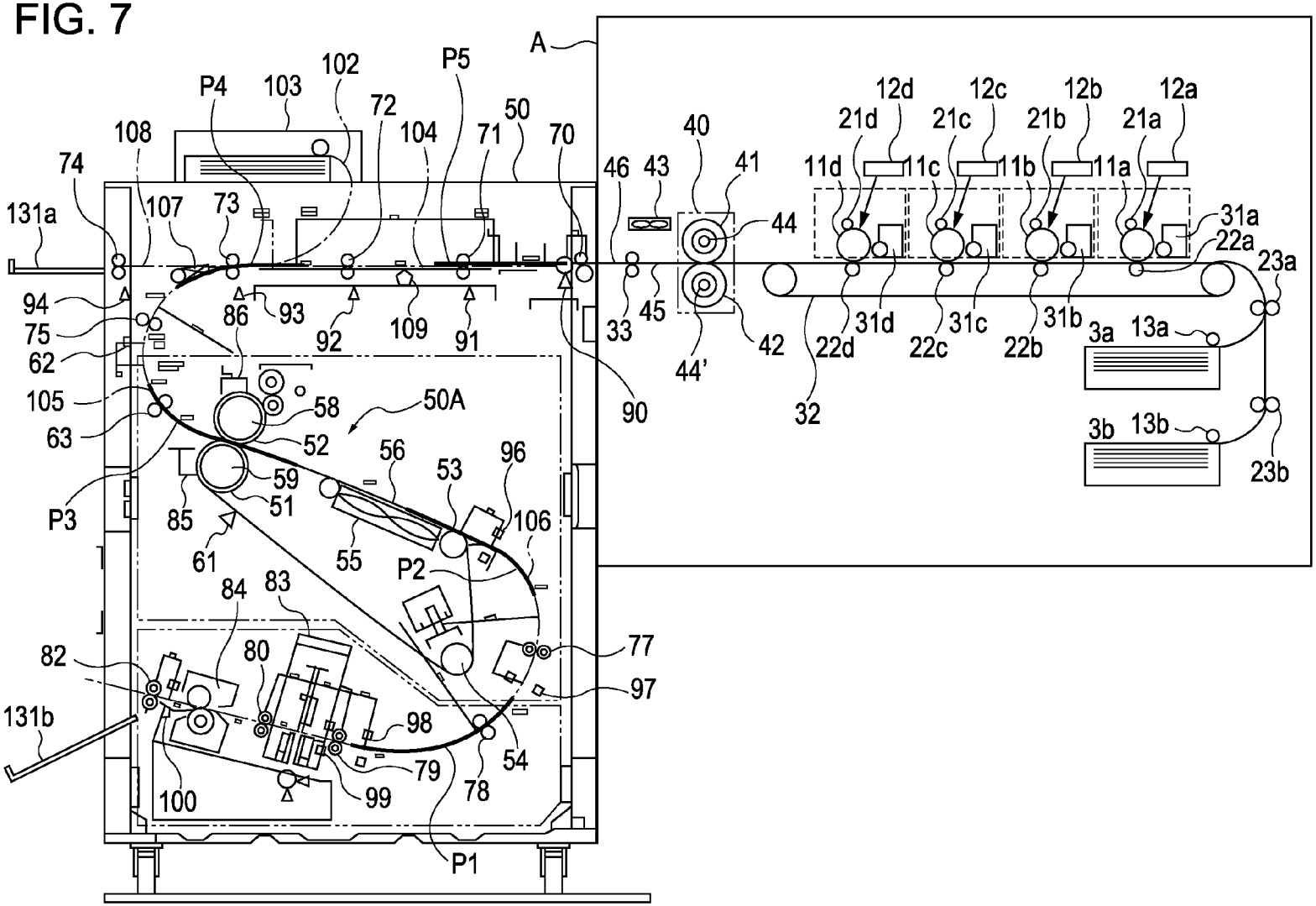
FIG. 7 schematically shows the flow of the second-type recording sheet when image information is continuously performed using the second-type recording sheets.

The second fusing mode will be described in detail below with reference to FIGS. 3-7. FIG. 3A schematically shows a fused state of the toner image on the second-type recording sheet having passed the first fusing unit 40, and FIG. 3B schematically shows a fused state of the toner image on the second-type recording sheet having passed the belt fusing unit 50A. FIG. 4 is a schematic view showing a state when the second-type recording sheet is separated from the fusing belt 56 of the second fusing unit 50. Each of FIGS. 5-7 schematically shows the flow of the second-type recording sheet when the image information is continuously performed using the second-type recording sheets. The following description is made of the case of continuously performing the image formation on five second-type recording sheets in a photographic mode. The photographic mode means a mode of forming an output image having quality comparable to that of a photo print obtained by silver salt photography.

When the image formation is continuously performed on five second-type recording sheets P1-P5, toner images of the respective colors for the first second-type recording sheet P1 are formed on the corresponding photoconductor drums, and the first second-type recording sheet P1 is fed at predetermined timing. The toner images of the respective colors are transferred to the first second-type recording sheet P1 in a superimposed manner, whereby a full-color toner image is transferred to the first second-type recording sheet P1. The first second-type recording sheet P1 is then sent to the first fusing unit 40. In the first fusing unit 40, the first second-type recording sheet P1 is heated and pressed so that the toner image is fused and fixated to the first second-type recording sheet P1. The first second-type recording sheet P1 having passed the first fusing unit 40 is cooled by the cooling fan 43 and is sent from the image forming apparatus A to the second fusing unit 50. At that time, the cooling fan 43 is driven under control corresponding to the second fusing mode. Details of the driving control of the cooling fan 43 in the second fusing mode will be described later.

The first second-type recording sheet P1 sent to the second fusing unit 50 is conveyed along the conveying path 104 by the conveying rollers 70, 71, 72 and 73 and is then introduced to the conveying path 105 by the flapper 107. The first second-type recording sheet P1 having been introduced to the conveying path 105 is conveyed by the conveying roller 75. When the first second-type recording sheet P1 is sensed by the sensor 62, the leading end of the first second-type recording sheet P1 is temporarily stopped in a state where it is abutted against the registration roller 63. At this time, as shown in FIG. 5, the second second-type recording sheet P2 is sensed by the sensor 92 and is held at standstill in a state where it is gripped by the conveying roller 72 in the form of a roller pair. The third second-type recording sheet P3 is passing the first fusing unit 40 of the image forming apparatus A. The fourth second-type recording sheet P4 is carried on and conveyed by the transfer belt 32 while the image formation is performed on the fourth second-type recording sheet P4. Further, the fifth second-type recording sheet P5 is in a state where it is fed from the sheet feed cassette 3*a* and is conveyed toward the transfer belt 32.

When the first second-type recording sheet P1 is temporarily stopped while being abutted against the registration roller 63, the fusing belt 56 is already in driven state. In accordance with an output of the sensor 61 for detecting the home position of the fusing belt 56, the CPU 401 computes the timing at which a recording-sheet holding position HT on the fusing belt 56 reaches a nip portion between the fusing belt 56 and the pressing roller 52. The registration roller 63 is rotated such that the computed timing is synchronized (matched) with the timing at which the leading end of the first second-type recording sheet P1 reaches that nip portion. The first second-type recording sheet P1 is thereby sent to that nip portion. The recording-sheet holding position HT on the fusing belt 56 means a reference position for the operation of placing (affixing) the second-type recording sheet onto the fusing belt 56. In other words, the second-type recording sheet is placed (held) onto the fusing belt 56 such that the leading end of the second-type recording sheet is matched with the recording-sheet holding position HT.

Then, the first second-type recording sheet P1 passes the above-mentioned nip portion. At that time, the first second-type recording sheet P1 and the toner image on the first second-type recording sheet P1 are heated to the predetermined fusing temperature and are pressed under the predetermined pressure by the fusing roller 51 and the pressing roller 52. As a result, the transparent resin layer formed on the first second-type recording sheet P1 is softened, thus resulting in such a state that the toner image is buried in the transparent resin layer.

More specifically, as shown in FIG. 3A, before the second-type recording sheet P passes the nip portion between the fusing belt 56 and the pressing roller 52, a toner image T is fused and fixated in a state where it is put on a transparent resin layer Pb formed on a base material Pa of the second-type recording sheet P. When the second-type recording sheet P passes that nip portion, as shown in FIG. 3B, the transparent resin layer Pb of the second-type recording sheet P is softened and the toner image T is buried in the transparent resin layer Pb. At the same time, the second-type recording sheet P is conveyed by the fusing belt 56 while being carried on it.

When the first second-type recording sheet P1 conveyed by the fusing belt 56 reaches the cooling area of the cooling fan 55, the first second-type recording sheet P1 is cooled in the cooling area by the airflow generated by the cooling fan 55. The airflow generated by the cooling fan 55 is introduced to the cooling area through a duct (not shown) so as to efficiently cool the first second-type recording sheet P1. Thus, since the toner image T is buried in the transparent resin layer Pb and cooled, an image on the first second-type recording sheet P1 is given with gloss comparable to that of a photo print obtained by silver salt photography.

When the first second-type recording sheet P1 having been cooled in such a way reaches an area where the curvature of the fusing belt 56 is changed with the presence of the driven roller 53, it is separated from the surface of the fusing belt 56 due to the rigidity (stiffness) of the paper. More specifically, as shown in FIG. 4, when the recording-sheet holding position HT on the fusing belt 56 reaches the area where the curvature of the fusing belt 56 is changed with the presence of the driven roller 53, the second-type recording sheet P starts to separate from the surface of the fusing belt 56 at the leading end thereof.

Then, as shown in FIG. 6, the first second-type recording sheet P1 having separated from the fusing belt 56 is conveyed along the conveying path 106 and passes the sensor 97. When the first second-type recording sheet P1 passes the sensor 97, the second second-type recording sheet P2 starts to be forwarded toward the nip portion between the fusing belt 56 and the pressing roller 52. At that nip portion, the second second-type recording sheet P2 is heated and pressed so that a toner image formed thereon is buried in the transparent resin layer of the second second-type recording sheet P2. Simultaneously, the third second-type recording sheet P3 is sensed by the sensor 62, and the leading end of the third second-type recording sheet P3 is temporarily stopped in a state where it is abutted against the registration roller 63. The fourth second-type recording sheet P4 is sensed by the sensor 92 and is held at standstill in a state where it is gripped by the conveying roller 72 in the form of a roller pair. The fifth second-type recording sheet P5 is passing the first fusing unit 40 of the image forming apparatus A.

Then, as shown in FIG. 7, the first second-type recording sheet P1 is conveyed to the position of the sensor 98 prior to cutter registration and is temporarily stopped while being gripped by the conveying roller 79 in the form of a roller pair. At that time, the second second-type recording sheet P2 is separated from the fusing belt 56 and is conveyed along the conveying path 106. The third second-type recording sheet P3 is passing the nip portion between the fusing belt 56 and the pressing roller 52. In the third second-type recording sheet P3, a toner image formed thereon is buried in the transparent resin layer as in the preceding second-type recording sheets P1 and P2. The fourth second-type recording sheet P4 is being conveyed along the conveying path 107, and the fifth second-type recording sheet P5 is being conveyed along the conveying path 104. Subsequently, the fourth and fifth second-type recording sheets P4 and P5 pass the above-mentioned nip portion, and toner images on the fourth and fifth second-type recording sheets P4 and P5 are buried in their transparent resin layers in a similar manner.

Then, the first second-type recording sheet P1 is sent to the cutters 83 and 84. The right and left ends and the leading and trailing ends of the first second-type recording sheet P1 are cut respectively by the cutters 83 and 84. The first second-type recording sheet P1 having been cut is ejected onto the sheet ejection tray 131*b*.

As with the first second-type recording sheet P1, the subsequent second-type recording sheets P2-P5 are successively sent to the cutters 83 and 84. The right and left ends and the leading and trailing ends of each of the second-type recording sheets P2-P5 are cut respectively by the cutters 83 and 84. The second-type recording sheets P2-P5 having been cut are ejected onto the sheet ejection tray 131*b*.

Figure 8:
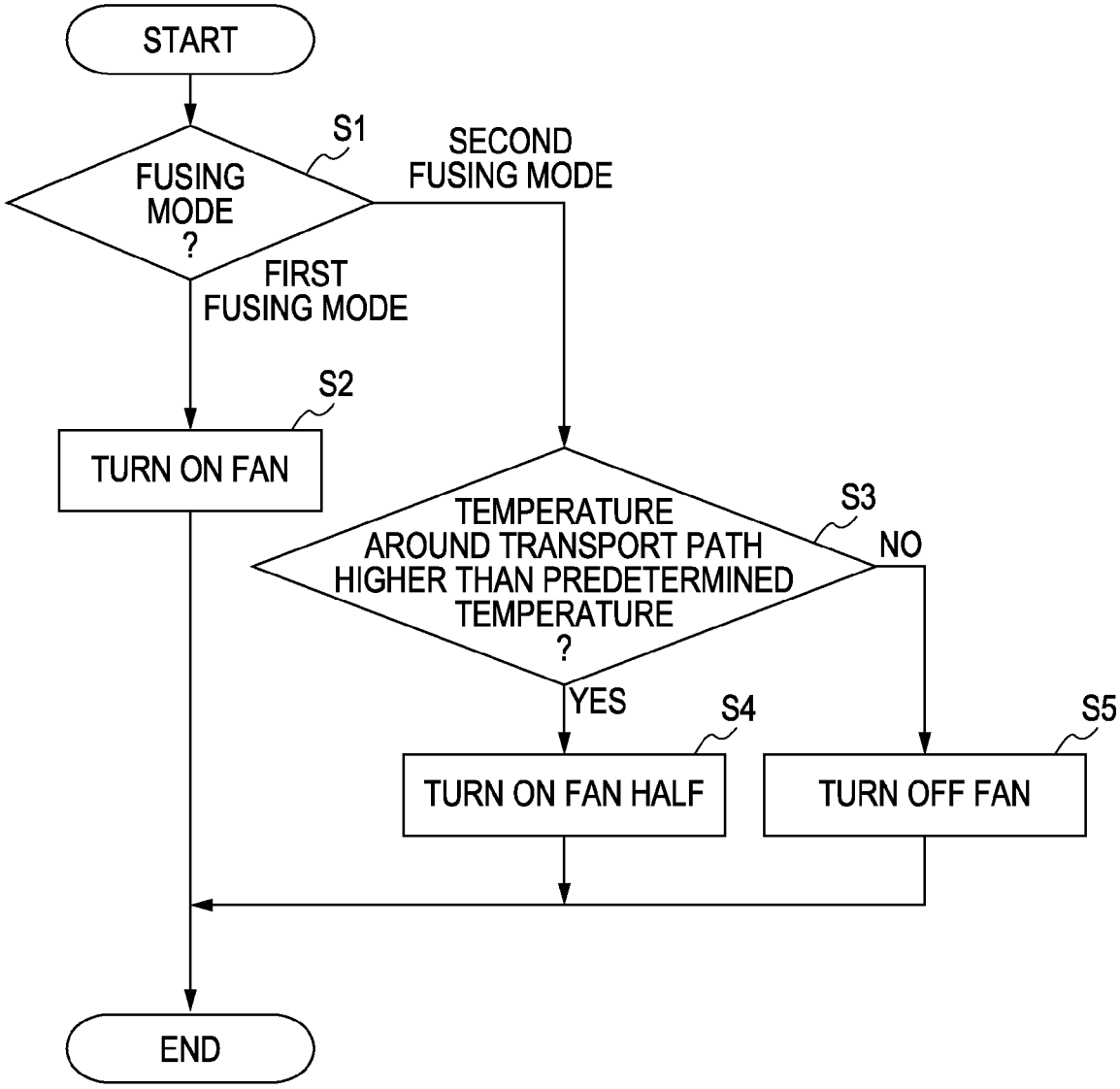
FIG. 8 is a flowchart showing procedures of driving control of a cooling fan.

The driving control of the cooling fan 43 will be described below with reference to FIG. 8. FIG. 8 is a flowchart showing procedures of the driving control of the cooling fan 43. The procedures shown in the flowchart of FIG. 8 are executed by the controller 400 (CPU 401) of the image forming apparatus A.

The driving control of the cooling fan 43 is executed by the controller 400 of the image forming apparatus A. This control is started in match with the start of a print job. The controller 400 receives a value detected by the temperature sensor 109 from the controller 500. As shown in FIG. 8, the controller 400 first determines whether the selected fusing mode is the first fusing mode or the second fusing mode (step S1). The first fusing mode is a fusing mode which is selected when the image formation is performed on the first-type recording sheet (ordinary recording sheet). The second fusing mode is a fusing mode which is selected when the image formation is performed on the second-type recording sheet. The selection of the fusing mode is automatically made depending on the image formation mode set by the user. For example, when an image formation mode using the first-type recording sheet is set, the first fusing mode is selected, and when an image formation mode using the second-type recording sheet is set, the second fusing mode is selected.

If it is determined in step S1 that the selected fusing mode is the first fusing mode, the controller 400 executes control such that the cooling fan 43 is driven at a full rotation speed (i.e., the fan is turned on) (step S2). The controller 400 then brings the process to an end. Thereafter, upon the completion of the print job, the controller 400 stops the driving of the cooling fan 43.

If it is determined in step S1 that the selected fusing mode is the second fusing mode, the controller 400 determines whether the temperature detected by the temperature sensor 109 is higher than a predetermined temperature (step S3). The temperature detected by the temperature sensor 109 corresponds to the temperature around the conveying path 104. If the temperature around the conveying path 104 is higher than the predetermined temperature, the controller 400 drives the cooling fan 43 at a half-full rotation speed (i.e., the fan is turned on half voltage) (step S4). The driving of the fan at the half-full rotation speed is performed by controlling a driving current supplied to the cooling fan 43. The controller 400 then brings the process to an end. Thereafter, upon the completion of the print job, the controller 400 stops the driving of the cooling fan 43.

If it is determined in step S3 that the temperature around the conveying path 104 is not higher than the predetermined temperature, the controller 400 stops the driving of the cooling fan 43 (step S5) and brings the process to an end. Thereafter, upon the completion of the print job, the controller 400 stops the driving of the cooling fan 43.

Thus, if the temperature around the conveying path 104 is higher than the predetermined temperature, the amount of heat dissipated to the surroundings from the second-type recording sheet being conveyed along the conveying path 104 is small, and a reduction in the temperature of the second-type recording sheet (i.e., the sheet temperature) until reaching the belt fusing unit 50A is also small. Therefore, the cooling fan 43 is driven at the half-full rotation speed in order to reduce the temperature of the second-type recording sheet. On the other hand, if the temperature around the conveying path 104 is not higher than the predetermined temperature, the amount of heat dissipated to the surroundings from the second-type recording sheet being conveyed along the conveying path 104 is large, and a reduction in the temperature of the second-type recording sheet (i.e., the sheet temperature) until reaching the belt fusing unit 50A is also large. Therefore, the cooling fan 43 is stopped to avoid the temperature of the second-type recording sheet from being reduced to a level lower than the necessary one.

In the above-described driving control of the cooling fan 43, the cooling fan 43 is driven at the half-full rotation speed or stopped depending on the temperature detected by the temperature sensor 109. In the second fusing mode, however, the cooling fan 43 may be controlled instead to be driven at the half-full rotation speed regardless of the temperature detected by the temperature sensor 109. Alternatively, the cooling fan 43 may be controlled to be stopped. Further, the rotation speed of the cooling fan 43 may be changed in more stages (e.g., at ⅔ and ⅓ of the full rotation speed) depending on the detected temperature.

Figure 9:
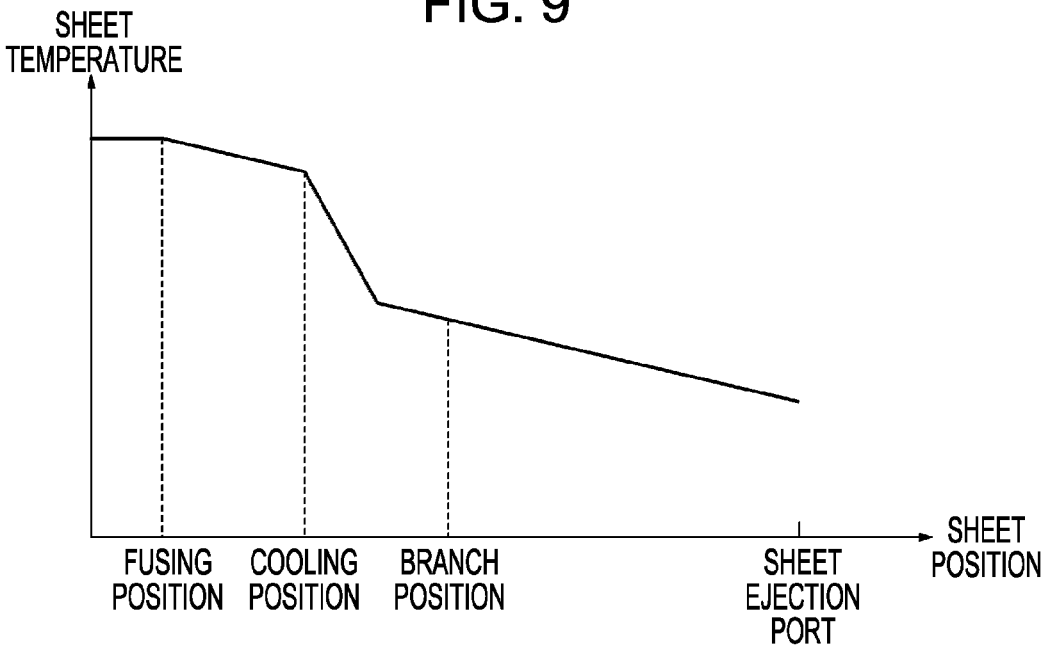
FIG. 9 is a graph showing temperature changes of a first-type recording sheet when the cooling fan is driven at a full rotation speed in a first fusing mode.
Figure 10:
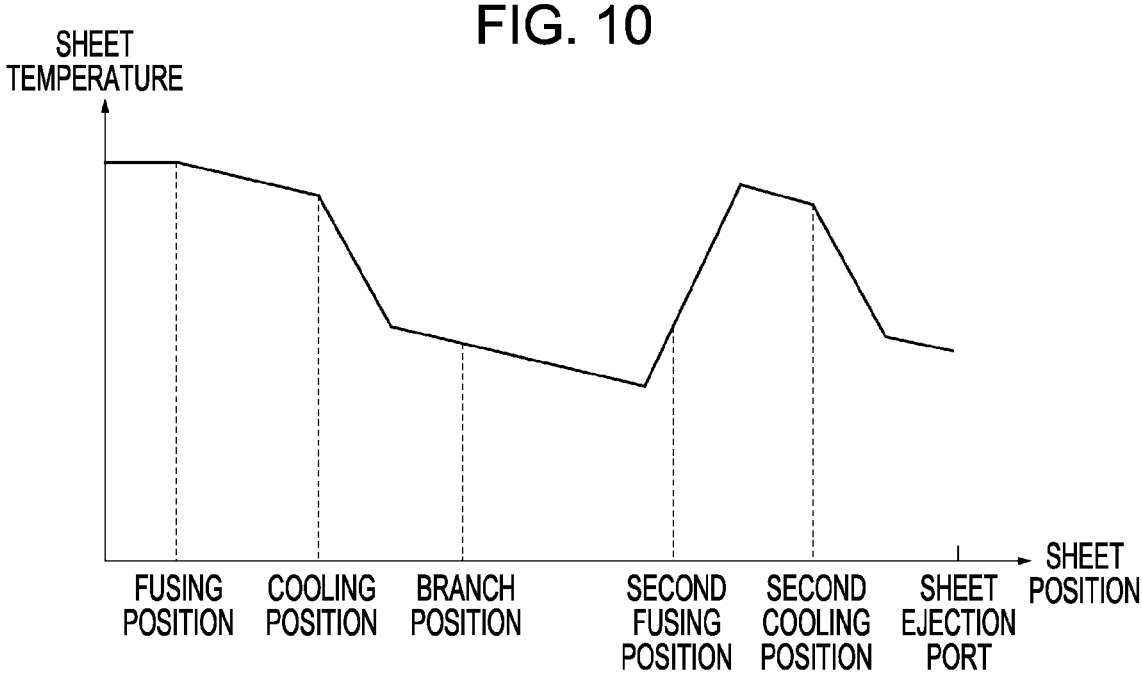
FIG. 10 is a graph showing temperature changes of the second-type recording sheet when the cooling fan is driven at the full rotation speed in a second fusing mode.
Figure 11:
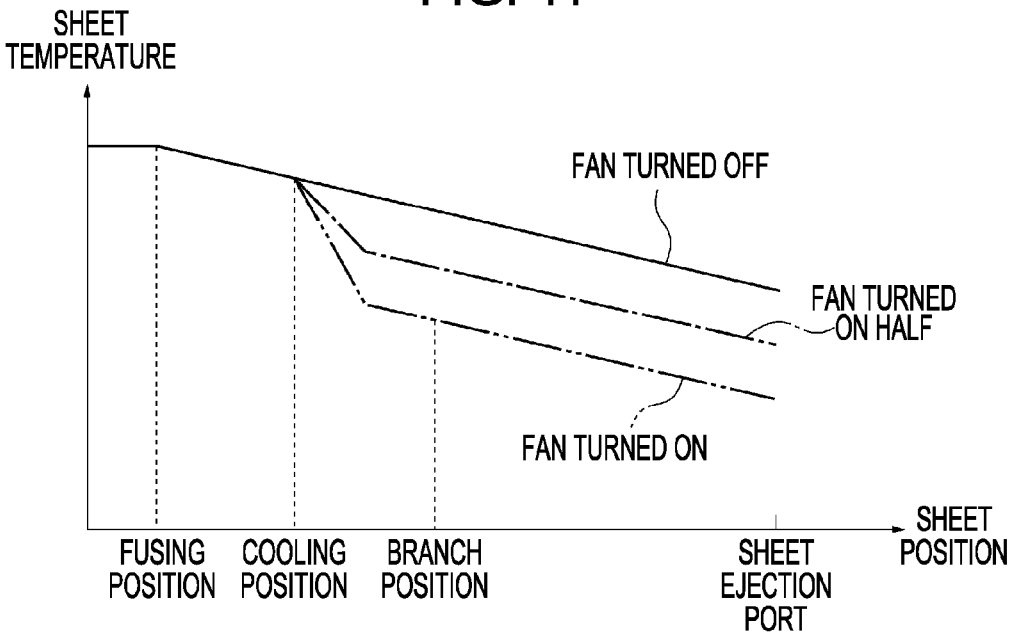
FIG. 11 is a graph showing temperature changes of the first-type recording sheet when the cooling fan is driven at three fan rotation speeds in the first fusing mode.
Figure 12:
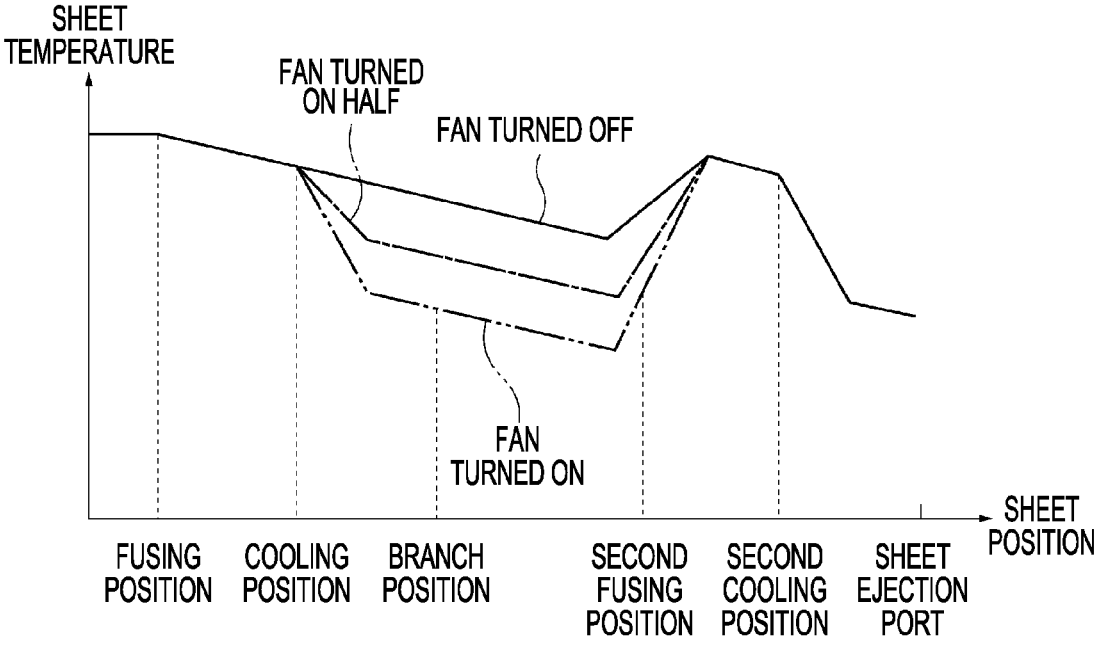
FIG. 12 is a graph showing temperature changes of the second-type recording sheet when the cooling fan is driven at the three fan rotation speeds in the second fusing mode.

Temperature changes of the recording sheet in the first fusing mode and the second fusing mode will be described below with reference to FIGS. 9-12. FIG. 9 is a graph showing temperature changes of the first-type recording sheet when the cooling fan 43 is driven at the full rotation speed in the first fusing mode. FIG. 10 is a graph showing temperature changes of the second-type recording sheet when the cooling fan 43 is driven at the full rotation speed in the second fusing mode. FIG. 11 is a graph showing temperature changes of the first-type recording sheet when the cooling fan 43 is driven at three fan rotation speeds in the first fusing mode. FIG. 12 is a graph showing temperature changes of the second-type recording sheet when the cooling fan 43 is driven at the three fan rotation speeds in the second fusing mode.

As shown in FIG. 9, when the cooling fan 43 is driven at the full rotation speed in the first fusing mode, the first-type recording sheet having passed the first fusing unit 40 and having been heated is quickly cooled at the position of the cooling fan 43, and the temperature of the first-type recording sheet (i.e., the sheet temperature) is abruptly reduced. Thereafter, when the first-type recording sheet is conveyed to the position where the cooling effect by the airflow of the cooling fan 43 does not act, the temperature of the first-type recording sheet is gradually reduced due to the temperature difference between the recording sheet itself and the surroundings. With the temperature of the first-type recording sheet reduced to a level not higher than a predetermined temperature at the position of the sheet ejection port (i.e., the position of the ejection roller 74), curl of the first-type recording sheet can be held at a minimum.

As shown in FIG. 10, when the cooling fan 43 is driven at the full rotation speed in the second fusing mode, the second-type recording sheet having passed the first fusing unit 40 and having been heated is quickly cooled at the position of the cooling fan 43, and the temperature of the second-type recording sheet (i.e., the sheet temperature) is abruptly reduced. Thereafter, when the second-type recording sheet is conveyed to the position where the cooling effect by the airflow of the cooling fan 43 does not act, the temperature of the second-type recording sheet is gradually reduced due to the temperature difference between the recording sheet itself and the surroundings. Then, the second-type recording sheet is conveyed toward the belt fusing unit 50A by the flapper 107. When the second-type recording sheet passes the nip portion between the fusing belt 56 and the pressing roller 52 in the belt fusing unit 50A, the temperature of the second-type recording sheet is abruptly increased. At that time, after electric power corresponding to the temperature increase is consumed by the belt fusing unit 50A (i.e., by the halogen lamps 58 and 59 of the fusing roller 51 and the pressing roller 52), the surface temperatures of the fusing roller 51 and the pressing roller 52 are reduced.

When the second-type recording sheet enters the cooling area of the cooling fan 55, the temperature of the second-type recording sheet is abruptly reduced. Thereafter, when the second-type recording sheet is conveyed to the position where the cooling effect by the cooling fan 55 does not act, the temperature of the second-type recording sheet is gradually reduced due to the temperature difference between the recording sheet itself and the surroundings. Because the temperature of the second-type recording sheet is reduced in such a way, it is possible to avoid unevenness of gloss in the image formed on the second-type recording sheet, which is otherwise caused by friction with the conveying rollers, the guide ribs, etc. disposed downstream of the cooling fan 55. With the temperature of the second-type recording sheet reduced to a level not higher than a predetermined temperature at the position of the sheet ejection port, curl of the second-type recording sheet can be held at minimum.

The following description is made of temperature changes of the first-type recording sheet when the cooling fan 43 is driven at three fan rotation speeds in the first fusing mode.

As shown in FIG. 11, when the cooling fan 43 is stopped (i.e., when the fan is turned off), the temperature of the first-type recording sheet is gradually reduced without being abruptly dropped until it is conveyed to the position of the sheet ejection port. In this case, the first-type recording sheet is curled and the quality in stack of the recording sheets on the sheet ejection tray 131*a* is deteriorated. Also, because the toner image after being fused is scraped by the conveying rollers, the guide ribs, etc. in a not-yet-dried state, unevenness of gloss appears in the image formed on the first-type recording sheet.

When the cooling fan 43 is driven at the half-full rotation speed (i.e., when the fan is turned on half), the first-type recording sheet is curled and unevenness of gloss appears though to such an extent as being less than the case where the cooling fan 43 is stopped. In order to avoid the curl of the recording sheet and the unevenness of gloss, therefore, the cooling fan 43 is controlled to be driven at the full rotation speed (i.e., in the fan turned-on state) in the first fusing mode.

The following description is made of temperature changes of the second-type recording sheet when the cooling fan 43 is driven at three fan rotation speeds in the second fusing mode.

As shown in FIG. 12, when the cooling fan 43 is driven at the full rotation speed (i.e., when the fan is turned on), the second-type recording sheet having been fused by the first fusing unit 40 is avoided from generating unevenness of gloss, which is otherwise caused by friction with the conveying rollers, the guide ribs, etc. However, the temperature of the second-type recording sheet (i.e., the sheet temperature) is reduced to a very low temperature at the time of reaching the belt fusing unit 50A, and the amount of heat to be applied to the second-type recording sheet in the belt fusing unit 50A is increased correspondingly.

By heating the second-type recording sheet again in the belt fusing unit 50A, it is possible to eliminate the unevenness of gloss in the image, which has been caused in the second-type recording sheet after the fusing in the first fusing unit 40. Accordingly, the necessity of quickly cooling the second-type recording sheet having passed the first fusing unit 40 by the cooling fan 43 is not essential. Because the second-type recording sheet having passed the nip portion in the belt fusing unit 50A is cooled by the cooling fan 55, the image formed on the second-type recording sheet can be avoided from causing unevenness of gloss, and deterioration of the quality in stack of the recording sheets due to curling can be held at minimum. In the second fusing mode, therefore, the cooling fan 43 is controlled to be stopped (turned off) or to be driven at the half-full rotation speed (turned on half) so that the temperature of the second-type recording sheet (i.e., the sheet temperature) at the time of reaching the belt fusing unit 50A is within a predetermined range. As a result, the amount of heat (electric power) consumed by the belt fusing unit 50A can be reduced.

In this embodiment, the first fusing mode or the second fusing mode is set depending on the image formation mode. Alternatively, the fusing mode may be selected to the first fusing mode or the second fusing mode by the user operation.

If a jam or another problem occurs in the second fusing unit 50 in the second fusing mode, the fusing mode may be switched to the first fusing mode such that the succeeding second-type recording sheet having passed the first fusing unit 40 is ejected onto the sheet ejection tray 131*a*.

Also, the cooling capability (volume of airflow) of the cooling fan 43 may be switched over in three or more stages. Further, an airflow adjusting mechanism, such as a damper, may be disposed to control the volume of airflow instead of directly controlling the volume of airflow of the cooling fan 43 (i.e., the fan rotation speed).

According to this embodiment, as described above, an image having no unevenness in gloss and having high quality can be stably outputted without increasing wasteful power consumption and enlarging the size of the driving mechanism in the belt fusing unit 50A.

The feature of the present invention can also be achieved by supplying a storage medium, which stores program code of software for realizing the functions of the above-described embodiment, to a system or an apparatus. In this case, a computer (CPU or MPU) in the system or the apparatus reads and executes the program code stored in the storage medium.

In that case, the program code read out of the storage medium serves to realize the functions of the above-described embodiment. Hence the storage medium storing the program code constitutes an implement for practicing the present invention.

Storage media for storing and providing the program code may be, e.g., floppy disks, hard disks, magneto-optical disks, CD-ROM, CD-R, and CD-RW. Other examples are DVD-ROM, DVD-RAM, DVD-RW, DVD+RW, magnetic tapes, nonvolatile memory cards, ROM, etc. Alternatively, the above-mentioned program may be supplied by downloading it via a network.

Also, the present invention involves not only the case in which the functions of the above-described embodiment can be realized by the computer executing the read program code, but also the case in which the functions of the above-described embodiment are realized by an Operating System (OS) or the like, which runs on the computer and executes a part or the whole of the actual processing in accordance with commands from the program codes.

Further, the program code read from the storage medium may be written in a memory provided in a function add-on board inserted in the computer or a function add-on unit connected to the computer. In this case, a CPU or the like incorporated in the function add-on board or unit may execute a part or the whole of the actual processing in accordance with commands from the program code, in order to realize the functions of the above-described embodiment.

As mentioned above, the functions of the above-described embodiment can be realized not only by the computer executing the read program code, but also the OS or the like running on the computer and executing a part or the whole of the actual processing in accordance with commands from the program codes. It is needless to say that the present invention involves the case where the functions of the above-described embodiment are realized with the OS or the like.

In that case, the program may be supplied directly from the storage medium storing the program, or may be supplied by downloading it from, e.g., another computer or database (not shown), which is connected to the Internet, a commercial network, a local area network, etc.

The program may be in the form of, e.g., object code, program code executed by an interpreter, or script data supplied to the OS.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-257064 filed Sep. 5, 2005 and No. 2006-202451 filed Jul. 25, 2006, which are hereby incorporated by reference herein in its entirety.

What is claimed is:

1. An image forming apparatus including:

a first heating device which heats a recording sheet having a developer image formed thereon;

a cooling device which cools the recording sheet having passed the first heating device;

a second heating device which heats the recording sheet having been cooled by the cooling device, thereby giving gloss to the image on the recording sheet;

a temperature sensor which is disposed in a conveying path for the recording sheet between the second heating device and the cooling device;

a control unit which controls the cooling capability of the cooling device in accordance with temperature detected by the temperature sensor; and a conveying device which includes a first conveying path for introducing the recording sheet having passed the cooling device to the outside, and a second conveying path for introducing the recording sheet having passed the cooling device to the second heating device, the first conveying path and the second conveying path capable of being alternatively selected, wherein when the first conveying path is selected, the control unit does not execute switching control of the cooling capability in accordance with the temperature detected by the temperature sensor.

2. The image forming apparatus according to claim 1, wherein the cooling device includes a fan, and the control unit controls the volume of airflow from the fan in accordance with the temperature detected by the temperature sensor.

3. The image forming apparatus according to claim 1, wherein the control unit reduces the cooling capability of the cooling device to a larger extent as the temperature detected by the temperature sensor is lower.

4. The image forming apparatus according to claim 1, wherein when a recording sheet having a resin layer formed thereon is conveyed, the control unit executes switching control of the cooling capability in accordance with the temperature detected by the temperature sensor.

* * * * *